United States Patent [19]

Chuply et al.

[11] 4,076,087

[45] Feb. 28, 1978

[54] HOLE REAMER

[76] Inventors: Vladimir Yakovlevich Chuply, ulitsa Kosmonavtov, 36, kv. 35; Leonty Feofanovich Vojuta, ulitsa Studencheskaya, 4, kv. 19; Feofan Ilich Kondratenko, ulitsa Kosmonavtov, 36, kv. 5; Jury Zakharovich Poludnenko, ulitsa Karla Marxa, 47, kv. 21; Adam Arsentievich Milach, ulitsa Studencheskaya, 4, kv. 22; Vladimir Nikolaevich Kobozev, ulitsa Yanova, 3, kv. 1; Alexandr Vasilievich Turchenko, ulitsa Kharitonova, 1b, kv. 32, all of Krivoi Rog, U.S.S.R.

[21] Appl. No.: 696,045

[22] Filed: Jun. 14, 1976

[51] Int. Cl.[2] ..... E21C 23/00

[52] U.S. Cl. ..... 175/334; 175/53; 175/381; 175/339; 299/31; 299/60

[58] Field of Search ..... 299/31, 60; 175/94, 175/98, 53, 334, 335, 381, 344, 339

[56] References Cited

U.S. PATENT DOCUMENTS

| | | | |
|---|---|---|---|
| Re. 24,965 | 4/1961 | Kirkpatrick | 299/31 |
| 1,333,491 | 3/1920 | Hughes | 299/31 |
| 1,399,831 | 12/1921 | Wadsworth | 175/334 X |
| 3,376,942 | 4/1968 | Van Winkle | 175/230 X |
| 3,437,380 | 4/1969 | Lawrence | 175/230 X |

FOREIGN PATENT DOCUMENTS

| | | | |
|---|---|---|---|
| 124,898 | 1/1959 | U.S.S.R. | 299/31 |

*Primary Examiner*—Ernest R. Purser
*Assistant Examiner*—Richard E. Favreau
*Attorney, Agent, or Firm*—Lackenbach, Lilling & Siegel

[57] ABSTRACT

A hole reamer according to the invention includes a main body or support with roller cutters rigidly connected to a drill stem, and an additional support with roller cutters arranged co-axially with the main body or support. A additional support device can move along the axis of the main body and is provided with a means to effect this longitudinal movement. The main body and additional support device are adapted to drill holes of one diameter with consequent reaming thereof.

8 Claims, 13 Drawing Figures

HOLE REAMER

The present invention generally relates to mechanical drilling of vertical and directional underground mine workings without blasting and more particularly to reaming of such workings.

The drilling machines of the present invention for drilling vertical and directional holes with the said hole reamer can also be used for constructing ore-chutes, tracks, wells for compressed air and water supply, holes for electric power supply mains, air and drain trunks, as well as workings to remove barren rock.

To develop drilling machines for sinking vertical and directional workings the problems of penetration rate improvement and efficiency should be solved along with the problem of drilling cost reduction.

Power requirements upon such a machine with roller or other type cutters depend on the square of the size of the hole reamed. The greater the size of the hole reamed, the more powerful should be the drilling machine drive, which, in turn, leads to an increase of the machine overall dimensions.

The conditions of underground mining and geology require that the drilling machine's overall dimensions exclude its disassembling when the machine is transported in the mine workings.

The drilling machines designed to ream vertical and directional mine workings to a size of 1.5 m comply with these requirements.

But vertical and directional mine workings which do not exceed 1.5 m in diameter are not popular in the mining industry, and the use of the drilling machines for reaming vertical and directional minings to 1.5 m or less in size is limited.

The drilling machines of this type can find more extensive use, if mining is reamed in two runs; in the first run the working is reamed to a diameter of 1.5 m and then, after changing the reamer for a tool of bigger size, the next reaming is performed. In both cases the drilling machine operates at full power.

The overall dimensions of the drilling machines designed to ream workings to a diameter in excess of 1.5 m exceed the size of mining workings and they should be disassembled while being transported and assembled under the restricted conditions of the drilling chamber. Besides, too large a drilling chamber is needed to accomodate such a machine, which is extremely undesirable according to mining regulations. Large drilling chambers in soft unstable rocks should have supports. The chambers of substantial dimensions adversely affect the integrity of a rock massif and raise substantial difficulties in maintaining active workings when mining useful minerals. This type of drilling machines has a narrow range of application.

A well known drilling hole reamer has a body with rock cutters mounted on it which is joined to the drill rod string with a flanged or threaded connection. The main body is a metal structure, the rock cutters being mounted on its top plate. In the main body bottom plate there are two or more pins used to connect an additional reamer body, the latter being a rigid structure with rock cutters mounted on it. The pins serve to transmit torque from the main body to the additional one. The additional body is bolted to the main one, the bolts also serving to transmit thrust forces.

Reaming a hole with reamer of this type is performed in the following sequence;

1. Drilling a pilot hole with a small size rock cutting tool. At this stage drill rods are added to the stem.
2. Reaming of the pilot hole with the reamer main body rock cutters. The process of reaming the pilot hole is accompanied by disassembling the drill rod stem.
3. Addition of drill rods to connect the additional body to the main one.
4. Reaming of the hole with the additional body rock cutters. The process of the second-run reaming is accompanied by disassembling the drill rod stem.
5. Assembling of the drill rod stem to disconnect the reamer.
6. Disassembling of the drill rod stem.

The process of reaming the hole is effective for drilling the pilot hole from an upper mine working to a lower one and reaming-up the pilot hole.

The second-run reaming is accompanied by a number of additional operations to assemble and disassemble the drill rod stem and mount the reamer additional body which involves substantial time losses, the latter resulting in a sharp decrease in penetration rate and increase in drilling cost.

Another known type of a hole reamer eliminates additional assembly and disassembly of the drill rod stem while reaming the mine working to a bigger size.

The design of such hole reamers features expanding assemblies with rock cutting elements, for instance roller cutters, mounted on them.

Another known type of a drill-reamer, connected to the drill stem features drill head body reducing into an extension of the drill stem.

One or several pneumatic cylinders are attached to the outer side of the drill head body to actuate expanding arms with rock cutters. The expanding arms are hinged to the drill head body.

The drill head may have a pneumatic cylinder connected only to one expanding arm, or one or several cylinders connected to a ring bushing which embraces the drill head body, two or more expanding arms with rock cutters being connected to the bushing by means of a guide rocker. The pneumatic cylinders are double-acting, the upper and lower chambers being connected to the air supply mains. Expanding or folding of the expanding arms with the rock cutters in the process of drilling is effected by supplying air to one of the chambers.

The sequence of operations in reaming a hole with such a reamer is as follows: first, a pilot hole is drilled; then compressed air is fed into the lower chamber of the pneumatic cylinder or cylinders; under the action of the force developed in the pneumatic cylinder or cylinders the expanding arms with the rock cutters are moved outwards which results in reaming the hole under the action of the thrust transmitted by the drill stem.

The main disadvantage of the drill-reamer is the complicated and unreliable design of the expanding arm universal joint. The expanding arms and universal joints should be very massive to conform the requirements of strength. Besides, the more is the diameter of the reamed hole, the more should be the number of arms, which makes it practically impossible to find place for the folded arms on the main body, as the overall dimensions of the latter are limited by much less size of the pilot hole.

When there are many expanding arms in the reamer their control becomes a problem and it is impossible to fix them in an expanded position so that the rock cutting elements contact the hole surfaces to be cut and be able to break them.

While using such reamers the rock cuttings fill all the slots and universal joints of the expanding arms and impede the latter from returning into the folded position, making further drilling impossible.

Another known type of a hole reamer consists of a main body with rock cutters and expanding arms with rock cutters which are hinged to said body on its periphery.

A mandrel is rigidly connected to the drill stem, one end of this mandrel being a piston of a hydraulic cylinder and the other having lugs of special profile which are intended for expanding the arms with rock cutters.

The mandrel is slidingly connected to the main body and transmits torque from the drill stem to the body. The cylindrical part of the main body disposed above the expanding elements serves as a housing for the hydraulic cylinder shell.

The piston-like part of the mandrel divides the cylinder shell into upper and lower pressure chambers.

When a hydraulic fluid is supplied into the upper pressure chamber the main body with the expanding arms is moved upwards relative to the mandrel, the expanding arms being moved outward the main body due to the action of the mandrel lugs of a special profile. The expanding arms are turned around the axis of the universal joints.

When the hydraulic fluid is supplied into the lower pressure chamber the main body with the expanding arms is moved downwards relative to the mandrel, the expanding arms being folded.

The sequence of operations in reaming a hole with such a reamer is as follows: first, a pilot hole is drilled with the main body rock cutters; then the hydraulic fluid is supplied into the upper pressure chamber of the hydraulic cylinder, and the main body with the expanding arms is moved upwards relative the mandrel, the expanding arms being expanded outward the main body by the mandrel lugs of a special profile and moving along the radius relative the universal joint axis. Reaming of the hole is effected due to the action of the thrust transmitted from the drill stem through the mandrel and main body to the expanding arms.

The main disadvantages of the reamer described above are that it is complicated and the design of the expanding arm universal joints is unreliable, with the rock cutters mounted in the expanding arms. The expanding arms and universal joints should be very massive to conform to the requirements of strength. The more the diameter is of the reamed hole, the more should be the number of the arms, which makes it practically impossible to find place for the folded arms on the main body, as the overall dimensions of the latter are limited by much less size of the pilot hole.

When there are many expanding arms in the reamer their control becomes a problem and it is impossible to fix them in an expanded position so that the rock cutting elements contact the hole surfaces to be cut and are able to break them.

While using such reamers the rock cuttings fill all the slots and universal joints of the expanding arms and impede the return of the latter into the folded position making further drilling impossible.

An object of the invention is to eliminate the above-mentioned disadvantages of the known hole reamers.

A further object of the invention is to improve drilling machine efficiency while they are used for reaming vertical mine workings.

Still further object of this invention is to ensure large diameter hole reaming using low-horsepower drilling machines.

Yet another object of the present invention is to reduce the number of auxiliary operations of assembling and disassembling drill stems in the process of large diameter hole reaming.

Another object of the invention is to improve hole reamer reliability.

Still another object of the present invention is to improve service life of the drill rods.

A further object of the present invention is to arrange an additional rock cutter support device in the reamer relative to the main body of the reamer so that the additional rock cutter support device or the main body ensures consequent reaming of the hole drilled by one of them, using full horsepower of the drilling machine both in main body and additional support device operation.

To attain these objects a hole reamer has a main body or support device with roller cutters, the said main body being rigidly connected to the drill stem, and an additional support device with roller cutters which is movable relative to said main body both the main body and the additional support device being capable of drilling a hole of one diameter with consequent reaming thereof to another one and, in accordance with the invention, said additional device being arranged coaxially with the main body and provided with a means to move the said additional support device longitudinally relative to said main body.

In the embodiment described above, where the additional support device is arranged co-axially with the main body and provided with a means to move the additional support device longitudinally relative to the main body, it is possible to use low-horsepower drilling machines for reaming vertical and directional holes to a diameter 1.7 – 2 times more than that of the hole for which the drilling machine drive is rated.

It is preferable to make the hole reamer means for longitudinal movement of the additional device as telescoping sleeves with springs arranged in them so that the roller cutters of the additional support device are arranged before the main body roller cutters when viewed from the bottom of the hole drilled to form a hole of smaller diameter.

It is also possible to make the hole reamer means for longitudinal movement of the additional support device as a hydraulic cylinder so that the roller cutters of the additional support device are arranged behind the main body roller cutters when viewed from the bottom of the hole drilled and ream the hole drilled by the main body roller cutters.

The means for longitudinal movement of the additional support device, made as a hydraulic cylinder, eliminates time losses during additional manipulations in handling drill rods, increases penetration rate, productivity of labour and service life of the drill stem tool joints and decreases drilling cost.

Other objects and advantages of the invention will become evident from the following description in which the preferred embodiments are set forth in detail in conjunction with the accompanying drawings, wherein.

Figure 1:
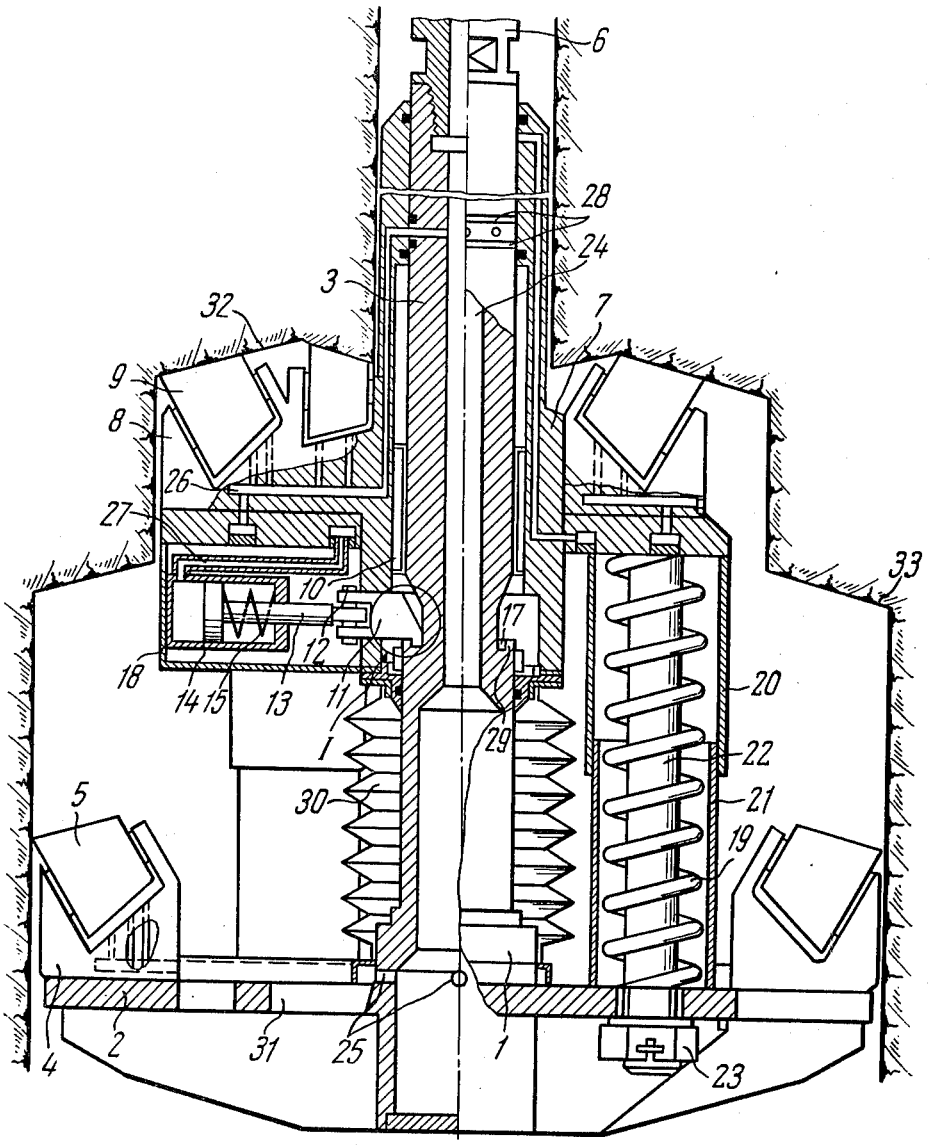
FIG. 1 shows a side elevational view, partly in cross-section, of a first embodiment of a hole reamer in accordance with the present invention.

The present hole reamer is designed for drilling a hole of one diameter of consequent reaming of the hole in the upward or downward direction.

First, a pilot hole may be drilled with a small size rock cutting tool with simultaneous addition of the drill rods into the drill stem, as the hole is deepened.

After the hole is drilled to a desired depth the small size rock cutting tool is substituted for the hole reamer which is rigidly connected to the drill stem end.

It is possible to drill and then ream a hole without boring a pilot hole with small size rock cutting means in advance. In this case the hole reamer is rigidly connected to the first rod of the drill stem.

As the hole is deepened the rods are added into the drill stem.

In accordance with the present invention at least two embodiments of the hole reamer can be made, the description of two embodiments and their principle of action being given below.

The two embodiments differ from each other in their means for moving the additional support device and the main body relative to each other.

One embodiment of the hole reamer features a main body or support device and means for moving an additional device longitudinally made as telescoping sleeves with springs arranged in them. This embodiment of the hole reamer consists of a welded steel main body 1 (FIG. 1) which comprises a plate 2 and a pipe 3. Supports 4 with the roller cutters 5 mounted in them are fixed on the plate 2. The main body 1 is rigidly connected to a drill rod 6 of a drill stem (not shown) with the help of the pipe 3. The main body 1 carries a co-axially mounted additional support device 7 (FIG. 2) which is a metal structure with supports 8 arranged in it and provided with roller cutters 9. The additional support device 7 is slidingly fitted on the main body 1, for instance, with the help of splines 10.

In the slots of the additional support device 7 there are mounted locking devices which are provided with stops 11 connected with universal joints 12 to the rods 13 of actuating cylinders 14. Springs 15 which serve to unlock the additional support device 7 are mounted on the rods 13 in the actuating cylinders 14.

The stops 11 are provided with hooks 16 (FIG. 3) which enter the slots 17 in the main body 1.

The actuating cylinders 14 together with stops 11 are enclosed with covers 18 to protect them from rock cuttings. Between the additional support device 7 and the main body 1 there are mounted springs 19 which are protected against contamination with rock cuttings by means of a sleeve 20 mounted in the additional support device 7 and a sleeve 21 mounted on the plate 2 of the main body 1. The sleeves 20 and 21 are able to telescope, i.e. move into and out of each other, when the reamer operates.

The springs are mounted on the rods 22. One end of the rod 22 is connected to the additional support device 7, the other end of the rod passing through the openings of the plate 2 is provided with nuts 23 which limit the movement of the additional support device 7.

In the process of reaming, a cooling medium is supplied to the roller cutters through the ports 24 and 25 in the main body 1 and through the ports 26 in the additional support device 7. The agent, for instance, compressed air is supplied into the cylinders 14 through the ports 27.

To prevent compressed air leakage when it is supplied into the actuating cylinders 14 seal rings 28 are installed on the pipe 3 of the main body 1.

Axial thrust is transmitted from the main body 1 through a surface 29 supporting the stops 11 when the hole is reamed by the additional support device 7.

To protect friction surfaces from rock cuttings an enclosure 30 is installed between the main body 1 and the additional support device 7. The rock cuttings accumulated on the main body 1 of the hole reamer are removed through the openings 31.

The above-described reamer operates as follows.

Figure 2:
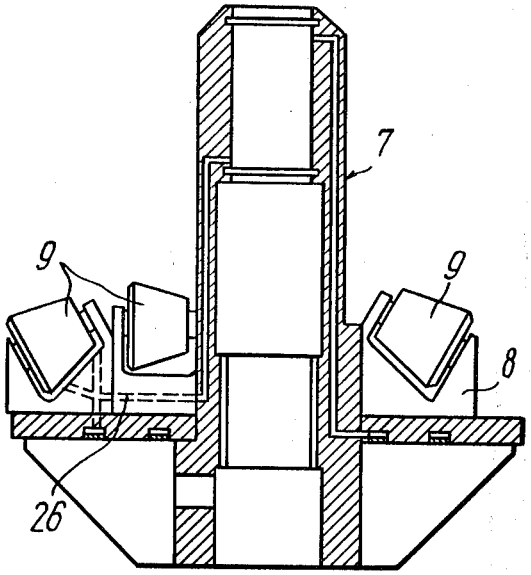
FIG. 2 shows the additional support device shown in FIG. 1.
Figure 3:
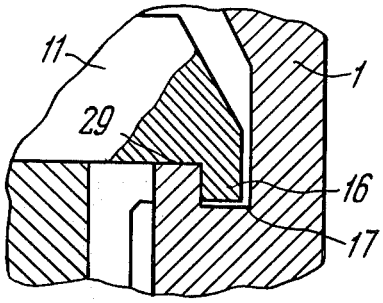
FIG. 3 shows an enlarged, fragmented view of the device shown in FIG. 1.
Figure 4:
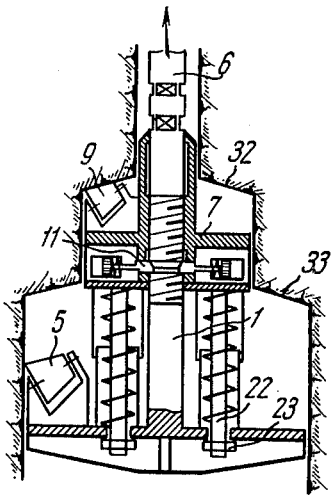
FIG. 4 shows the position of the first hole reamer embodiment in the process of drilling a small diameter hole with the additional support device.

When a smaller diameter hole is drilled (FIG. 4) and the roller cutters 9 of the additional support device 7 are acting on the bottom surface 32, the stops 11 are positioned so that the hooks 16 are engaged with the slot 17 (FIGS. 1, 3, 4).

The axial thrust of the drill stem 6 is transmitted through the surface 29 of the main body 1 of the hole reamer by means of the stops 11 positioned in the slots of the additional support device 7 to the additional device 7 and roller cutters 9.

Figure 5:
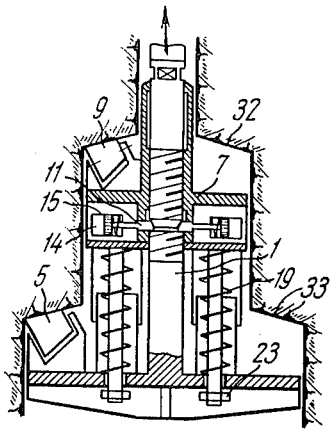
FIG. 5 shows the position of the first hole reamer embodiment at the moment when the main body roller cutters come into contact with the bottom of the hole.

At the same time the torque is transmitted from the drill stem 6 through the main body 1 of the hole reamer and splines 10 to the additional support device 7. Cutting of the bottom surface 32 proceeds until the roller cutters 5 of the main body 1 come into contact with the bottom surface 33 (FIG. 5).

As soon as all the roller cutters of the hole reamer come into contact with the bottom, the loading of the drilling machine driving motor, as well as the input current doubles indicating the necessity of switching the reamer to reaming the hole with the roller cutters 5 of the main body 1.

Figure 6:
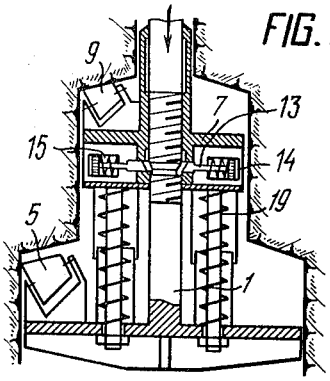
FIG. 6 shows the position of the first hole reamer embodiment when it is prepared to ream the hole drilled with the additional support device using the main body roller cutters.

For this purpose the drill stem 6 with the reamer is withdrawn from the bottom, as shown in FIG. 6.

In this case the main body 1 with the rock cutters 5 is taken off the bottom surface 33 and the additional support device 7 is forced by the springs 19 to move along the splines 10 relative to the main body 1 and disengages the stops 11.

A clearance is formed between the surface 29 (FIG. 2) of the main body 1 and the stops 11, and the stop hooks 16 leave the slot 17.

When the pressure of the agent in the actuating cylinders 14 is relieved by the operator or drilling machine automatic control system the springs 15 force the pistons with rods 13 away from the hole reamer axis (FIG. 6).

The hole reamer is again forced to the bottom with the help of the drill stem until the roller cutters 5 of the main body 1 come into contact with the bottom surface 33, and the process of reaming the hole with the roller cutters 5 of the main body 1 of the hole reamer is begun (FIG. 6).

As the bottom surface 33 is cut by the cutters of the main body 1, the latter comes closer to the additional support device 7, which is constantly pushed away from the main body 1 by the action of the springs 19, and pressed against the bottom surface 32. The roller cutters 9 of the additional support device 7 are pressed against the bottom surface 32 only by the action of the springs 19 and do not cut the rock.

Figure 7:
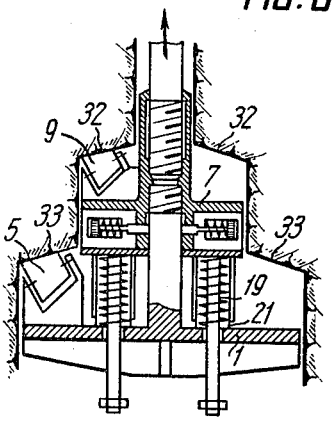
FIG. 7 shows the position of the first hole reamer embodiment in the process of reaming the hole drilled with the additional support device using the main body roller cutters.

The roller cutters 5 of the main body 1 cut the bottom surface 33 thereby reaming the hole until the sleeves 21 come into contact with the additional support device 7 as shown in FIG. 7.

Since this moment the hole is reamed not only by the roller cutters of the main body but also by the roller cutters of the additional support device, this results in a sharp increase of the electric motor current and it becomes necessary to withdraw the roller cutters 5 of the main body from the bottom surface 33.

The drill stem 6 together with the main body 1 and additional support device 7 is lowered for the length of the hole reamer travel, the roller cutters 5 of the main body 1 being taken off the bottom surface 33 and the additional support device 7 sliding along the splines 10 upwards relative to the main body 1 under the action of springs 19.

When the main body 1 and the additional support device 7 come into extreme extended position nuts 23 of the rods 22 bear up against the main body 1 thus limiting relative travel of the main body 1 and the additional support device 7.

Under the action of the agent which is being supplied into the actuating cylinders 14 the pistons compress the springs 15 and push the stops 11 to the hole reamer axis.

When the drill stem 6 is being pulled upwards, the roller cutters 9 of the additional support device 7 bears up against the bottom surface 32, the main body 1 and the additional support device 7 move relative to each other and the hooks 16 of the stops 11 enter the slots 17.

The hole reamer returns into its original position and the bottom surface 32 is cut (FIG. 4).

Following this all the above-described operations are repeated until all the hole is reamed.

Figure 8:
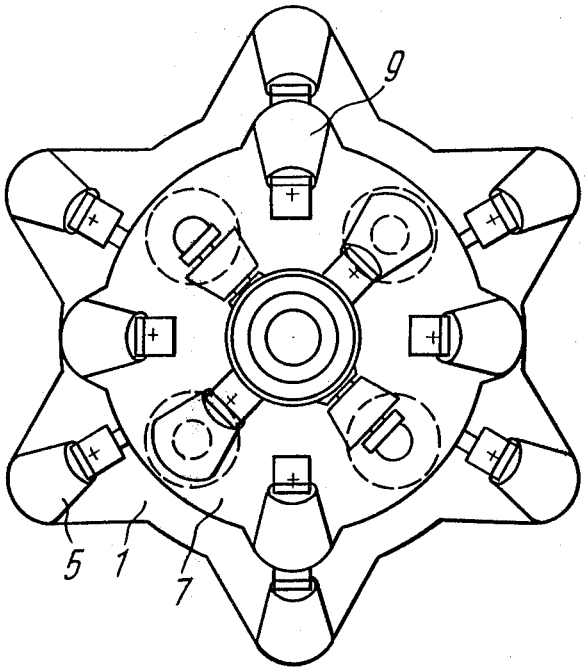
FIG. 8 shows the plan view of the hole reamer shown in FIG. 1.

FIG. 8 shows the arrangement of the roller cutters 5 on the main body and that of the roller cutters 9 on the additional support device 7 of the hole reamer.

It is to be understood that the form of the invention herewith shown and described is to be taken as a possible preferred embodiment, and that various changes in the shape, size and arrangement of specific elements (springs, locking devices) may be resorted to.

The above-described and shown parts may be changed for equivalent ones, the arrangement of specific parts may be changed, specific elements of the invention may be changed or replaced by equivalent elements if enumerated changes are within the scope of the appended claims.

The second embodiment of the invention is a hole reamer with a hydraulic cylinder used to move an additional support device.

The illustrated second embodiment of the invention (FIG. 9) comprises a main body 34 rigidly connected through a spindle 35 to a drill stem 36. Guide pipes 37 embraced by a frame 38 in their lower parts are rigidly fixed in the lower part of the main body 34.

The additional support device 39 is mounted on the guide pipes 37, the former being able to slide along the hole reamer axis on sleeve 40 under the force transmitted by a rod 41. The rod 41 is connected to the additional support device 39 and inserted into a cylinder 42 rigidly connected to a frame 38.

A carrier 44 is fitted on the shell of hydraulic cylinder 42 using bearings 43 and radial support mounts 45 with rollers 46. The radial supports 45 are loaded with springs 47. A tooth rim 48 is mounted in the carrier, the former being engaged with a pinion-shaft 49 of an intensifier 50.

An oil pump 51 is installed at the output of the intensifier 50.

The intensifier is fastened to the frame 38.

The frame 38 also mounts a slide valve 52 with a limit switch 53. In its extreme positions the limit switch 53 contacts a stop 54 which is mounted on the additional support device 39. The oil pump 51 is connected to an oil tank 56 through a supply line 55. The hydraulic cylinder 42 is connected to a discharge line 59 through a pressure maintaining valve 58, the discharge line 59 being branched into two lines. One line goes to the pump 51, the other goes to the slide valve 52. A drain line 60 goes from the slide valve 52 to the oil tank 56.

On the additional support device 39 there is mouted a sheath 61 which overlaps a liner 62 mounted on the carrier 44.

Protecting rings 63 are mounted between the plate of the main body 34 and the additional support device 39.

The above-described hole reamer operates as follows.

Figure 10:
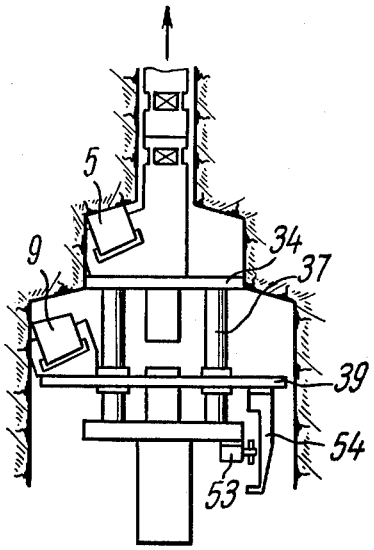
FIG. 10 shows the position of the second hole reamer embodiment in the process of drilling a small diameter hole with the main body roller cutters.

After a pilot hole is drilled the hole reamer is connected through its spindle 35 to the drill stem 36, and the hole is reamed with the roller cutters of the main body 34 (FIG. 10), the carrier 44 should be locked against rotation before reaming the working. The carrier 44 must remain locked until the rollers 46 of the radial supports 45 enter the hole, the carrier being locked against rotation by means of the springs 47.

As the force necessary to prevent the carrier 44 from rotation is small (in the order of 150 kg) it may be temporarily locked, for instace by a chain (not shown).

The main body 34, being rotated by a drilling machine through the drill stem 36, imparts rotation to the additional support device 39 through the guide pipes 37. Only the carrier 44 remains stationary as it is locked and mounted on the rotating shell of the hydraulic cylinder 42 by means of bearings 43.

The tooth rim 48 also remains stationary. The intensifier 50, being connected to the frame 38 also rotates along with the main body 34 and the additional support device 39 of the hole reamer.

The pinion-shaft 49 much like a satellite gear, being engaged with the rim 48, rolls on the rim 48. When the speed of pinion-shaft rotation reaches a certain value and is multiplied in the intensifier to the value required for stable operation of the oil pump 51, connected to the output shaft of the intensifier, the pump 51 takes in oil from the oil tank 56 through the supply line 55 and produces working pressure delivering oil through the discharge line 59 to the hydraulic cylinder 42 via the pressure maintaining valve 58.

The oil is also supplied to the slide valve 52 and, as in all hydraulic systems, to a safety valve set at the working pressure necessary.

If the slide valve 52 is open the oil freely flows from the discharge line 59 into the drain line 60 and then is drained to the oil tank 56. Pressure is not produced in the system and the pump 51 operates being unloaded. The pressure maintaining valve 58 is adjusted so that the pressure in the hydraulic cylinder stays at the level which is slightly above that necessary to support the additional support device 39.

The oil cannot flow freely from the hydraulic cylinder 42, this flow being set up only when the additional support device 39 is pressed against the hole bottom surface by the thrust of the drill stem 36.

If the slide valve 52 is closed all the oil flows under pressure into the hydraulic cylinder 42 exerting pressure under the rod 41 and forcing it to move so that the roller cutters 9 of the additional support device 39 be able to cut the rock.

Figure 9:
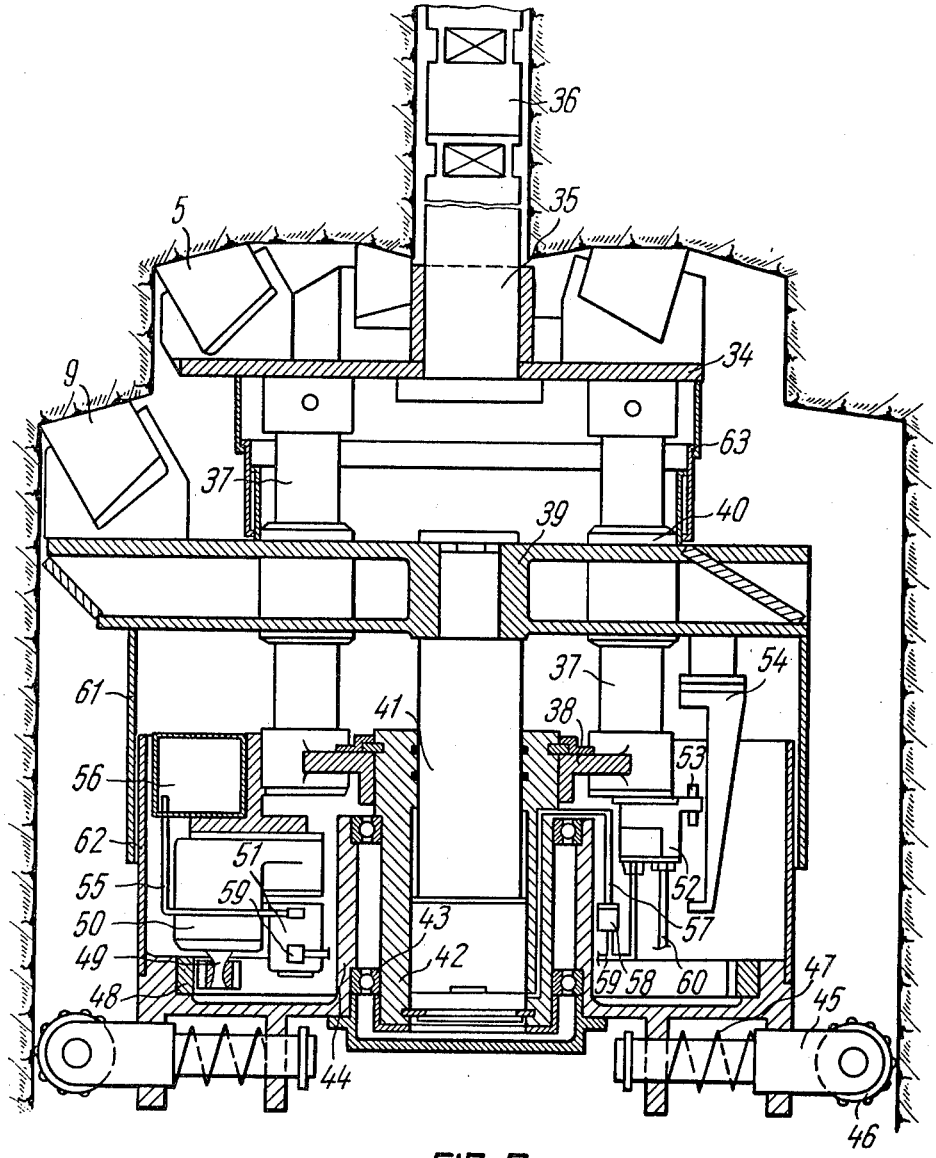
FIG. 9 shows a side elevational view, partly in cross-section, of a second embodiment of a hole reamer embodiment in accordance with the present invention.

When reaming the hole with the roller cutters 5 of the main body 34 the slide valve 52 is open and the oil is drained (FIG. 9).

Figure 11:
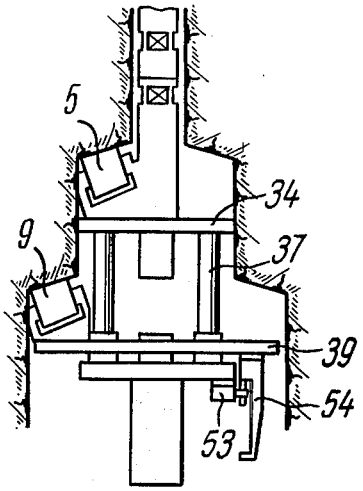
FIG. 11 shows the position of the second hole reamer embodiment at the moment when the additional support device roller cutters come into contact with the bottom of the hole.

Reaming the hole with the main body 1 is performed until the roller cutters 9 of the additional supprt device 39 come in full contact with the hole bottom surface (FIG. 11). As this takes place the hydraulic cylinder 42 executes its full relative travel, and the stop 54 presses the limit switch 53 with its upper shoulder, the limit switch shutting off free draining of oil with the help of the slide valve. The oil flows into the hydraulic cylinder 42 under pressure.

At this moment the roller cutters 5 of the main body 34 and the roller cutters 9 of the additional support device 39 are fully pressed against the hole bottom surface, and the torque at the drill stem and thus at the drilling machine motor shaft markedly increases.

The current is also incresed which is observed by the operator of the drilling machine or monitored automatically.

Figure 12:
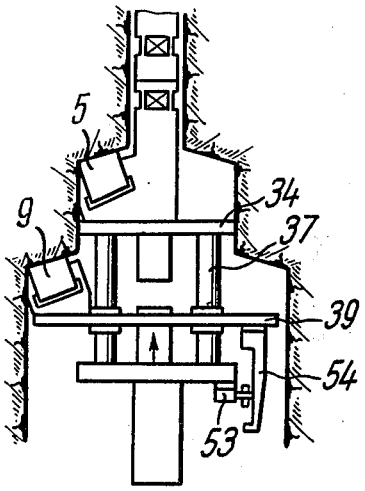
FIG. 12 shows the position of the second hole reamer embodiment when it is prepared to ream the hole drilled.
Figure 13:
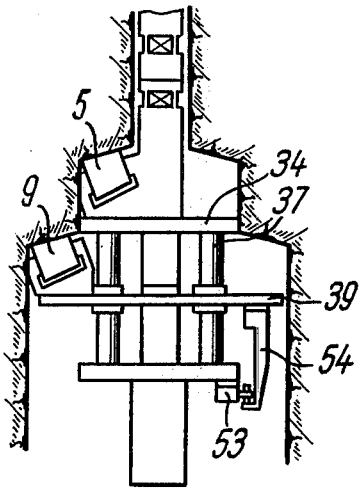
FIG. 13 shows the position of the second hole reamer embodiment in the process of reaming the hole drilled with the main body roller cutters using the additional support device.

On finding that all the roller cutters of the hole reamer are in operation, the operator stops feeding the drill stem 36 against the hole bottom without stopping its rotation. The drill stem 36 is rotated, but does not move longitudinally. The hydraulic cylinder 42 exerts a force and moves the additional support device 39 along the guide pipes 37, this device 39 cutting the rock on the bottom surface on a bigger diameter (FIG. 12). The additional support device 39 moves until it reaches its extreme position, the stop 54 pressing the limit switch 53 with its lower shoulder and the switch shifting the slide valve into the free-drainage position (FIG. 13). The axial thrust in the hydraulic cylinder thereby vanishes and the torque at the drill stem 36 and drilling machine motor shaft drops to zero (friction losses excluded).

The current in the drilling machine motors thereby decreases which is observed by the operator or monitored automatically. It means that reaming the hole with the additional support device 39 is finished. The operator feeds the drill stem 36 again and continues reaming the hole with the rock cutters of the main body 34. As the hole is deepened the additional support device 39 is moved downwards until the moment of switching. Then operations follow the above-described order.

The moment when the main body is brought into action can also be observed by the hydraulic cylinder rod travel, switching being effected at the extreme extended and pulled-in positions of the hydraulic cylinder rod.

As the hydraulic cylinder 42 is able to produce a force required to ream the hole it is possible to ream vertical and directional workings in one run of the drill stem without additional operations to handle the drill stem as in the first embodiment. These operations are reduced to the following: the drill stem is continuously fed against the hole bottom and stopped when reaming of the well is performed with the additional support device. The process of reaming thus becomes uninterrupted which makes the reamers much more effective.

What is claimed is:

1. A hole reamer adapted to cooperate with a drill stem comprising a main body or support device with roller cutters adapted to be rigidly coupled to the drill stem; an additional body or support device with roller cutters arranged co-axially with said main body and mounted for rotary movement with said main body or support device and for relative axial movement with respect thereto along the axis of said main body; means for axially moving said additional support device relative to said main body; means for locking said additional body against axial movement relative to said main body at a predetermined axial distance therebetween, said main body and additional support device being arranged to successively operate on and destroy substantially distinct and separate portions of the face of the hole to be drilled.

2. A hole reamer, as claimed in claim 1, wherein said main body has slots, and wherein said additional support device is provided with means for locking in the nature of stops and hooks coupled with pneumatic cylinders and return springs, said hooks being adapted to enter and engage said slots in said main body to lock said additional support device relative to said main body.

3. A hole reamer, as claimed in claim 1, wherein said roller cutters on said main body and additional support portions are arranged at different radial distances from said axis of rotation of said main body, whereby said roller cutters are respectively adapted to drill a hole of one diameter with subsequent reaming the resulting hole to another diameter.

4. A hole reamer, as claimed in claim 1, wherein said means for axial movement of said additional support device relative to said main body comprises telescoping sleeves; springs arranged within said sleeves, said sleeves being arranged between said main body and additional support device for successively placing the latter and said main body into operative position, said roller cutters of said additional support device being disposed in front of said roller cutters of said main body, when viewed from the bottom of the hole being formed, so that said roller cutters of said additional support device could destroy and drill a smaller diameter respective portion of the hole face.

5. A hole reamer, as claimed in claim 4, wherein said main body has slots, and wherein said additional support device is provided with means for locking in the nature of stops with hooks coupled with pneumatic cylinders and return springs, said hooks being adapted to enter and engage said slots in said main body to lock said additional support device relative to said main body.

6. A hole reamer, as claimed in claim 1, wherein said main body and additional support device are arranged to successively operate on and destroy substantially equal portions of the face of the hole to be drilled.

7. A hole reamer, as claimed in claim 1, wherein said means for axial movement of said additional support device relative to said main body comprises a hydraulic cylinder arranged between said main body and additional support device for successively placing the latter and said main body into operative position, said roller cutters of said additional support device being disposed behind said roller cutters of said main body, when viewed from the bottom of the hole being formed, so that said roller cutters of said additional support device ream the hole drilled by said roller cutters of said main body by destroying the larger diameter respective portion of the hole face.

8. A hole reamer, as claimed in claim 7, wherein said means for axial movement of said additional support device relative to said main body further comprises guide pipes connected rigidly to said main body, said additional support device cooperating with said guide pipes and being guided by the latter during axial movements relative to said main body.

* * * * *